US006508333B2

(12) United States Patent
Kostka et al.

(10) Patent No.: US 6,508,333 B2
(45) Date of Patent: Jan. 21, 2003

(54) METHOD OF CONTROLLING ELEVATOR INSTALLATION WITH MULTIPLE CARS

(75) Inventors: Miroslav Kostka, Ballwil (CH); Kurt Steinmann, Rotkreuz (CH)

(73) Assignee: Inventio AG, Hergiswil NW (CH)

( * ) Notice: Subject to any disclaimer, the term of this patent is extended or adjusted under 35 U.S.C. 154(b) by 0 days.

(21) Appl. No.: 09/949,741

(22) Filed: Sep. 10, 2001

(65) Prior Publication Data

US 2002/0033306 A1 Mar. 21, 2002

(30) Foreign Application Priority Data

Sep. 20, 2000 (EP) ..... 00810854

(51) Int. Cl.[7] ..... B66B 1/00
(52) U.S. Cl. ..... 187/382; 187/902
(58) Field of Search ..... 187/380, 382, 187/385, 386, 387, 388, 902

(56) References Cited

U.S. PATENT DOCUMENTS 4,632,224 A 12/1986 Nowak et al.
4,836,336 A 6/1989 Schroder
5,086,883 A 2/1992 Schroder
5,625,176 A * 4/1997 Davis et al. ..... 187/387
5,861,587 A 1/1999 Powell et al.
6,176,351 B1 * 1/2001 Ikeda et al. ..... 187/387
6,293,368 B1 * 9/2001 Ylinen et al. ..... 187/382
6,360,849 B1 * 3/2002 Hikita ..... 187/381
6,364,065 B1 * 4/2002 Hikita ..... 187/382
6,401,874 B2 * 6/2002 Siikonen ..... 187/382

FOREIGN PATENT DOCUMENTS

EP 0 459 169 6/1990

OTHER PUBLICATIONS

Fortune, James W., "Modern Double–Deck Elevator Applications and Theory", Elevator World, Aug. 1996, pp. 63–69.

* cited by examiner

*Primary Examiner*—Jonathan Salata
(74) *Attorney, Agent, or Firm*—MacMillan, Sobanski & Todd, LLC

(57) ABSTRACT

An elevator installation with multiple deck cars serves several floors simultaneously with one stop is controlled such that the travel requests are allocated to the most suitable elevator car of the elevator group and the allocation of a travel request from a starting-point floor to a destination floor to a car deck of the elevator car takes place shortly before reaching the starting-point floor. A travel request can also be redistributed or allocated to another deck at any time up to shortly before reaching the starting-point floor. The allocation of the travel request is carried out in dependence on general criteria and/or in dependence on allocated travel requests for the region of the starting-point floor and/or in dependence on allocated travel requests for the region of the destination floor.

14 Claims, 10 Drawing Sheets

Deck Allocation

Deck Allocation

31
Selection of the most favourable lift for servicing the destination call
32
Part 1
30

33
Service only by UD
Y
34
UD allocated
N
35
Service only by OD
Y
36
OD allocated
N
37
SPUD=S
N
38
SPOD=S
Y
39
PHBR or PHH
Y
N
Y
40
PHBR or PHH
Y
41
UD allocated
N
42
OD allocated
N
43
Load balancing desired
Y
44
LOD<UGLOD
N
Y
45
LUD>OGLUD
N
Y
49
OD allocated
46
LUD<UGLUD
N
Y
UD allocated
47
LOD>OGLOD
Y
48
N
50
Part 1A 50
51
Part 1A
52
S < Z
53
solution description
see text
N
Y
54
SP < S
N
Y
61
allocate UD
Y
59
reversal point at S
N
55
VH at S-1
for UD
60
VH at S-1
for UD
N
Y
62
56
VH at S
for OD
allocate OD
Y
N
57
VH at S
for UD
Y
N
58
63
VH at S+1
for OD
allocate UD
Y
N
64
Part 1B

METHOD OF CONTROLLING ELEVATOR INSTALLATION WITH MULTIPLE CARS

BACKGROUND OF THE INVENTION

The present invention relates to a method of controlling an elevator installation with multiple cars, by means of which several floors can be served with one stop, wherein the travel requests are allocated to the elevator car.

There has become known from the European patent specification EP 0 459 169 a destination call control for a elevator installation with multiple cars, wherein a call is allocated directly after input and the allocated elevator and the position of the elevator car are displayed on a display field of the actuated call registration device. Associated with each car deck is the call store in which are stored the calls that are input at the main stopping point and characterize the destination floors. A switching circuit is connected at the input side with the call stores in such a manner that in dependence on an allocated call the relevant multiple car is established as stopping at even-numbered/uneven-numbered or uneven-numbered/even-numbered floor pairs. At the output side, the switching circuit is connected by way of a switching device with a comparison device, so that, in dependence on a further call still to be allocated, neither the multiple cars stopping at even-numbered/uneven-numbered floor pairs or the multiple cars stopping at uneven-numbered/even-numbered floor pairs can participate in the comparison and allocation method.

A disadvantage of the known device is that the route of the multiple car is already limited to the main stopping point by the allocation of the even-numbered/uneven-numbered or the uneven-numbered/even-numbered floor, which in turn adversely influences the carrying capacity of the elevator installation.

SUMMARY OF THE INVENTION

The present invention concerns a method for the operation of an elevator installation meets the objective of avoiding the disadvantages of the known device and of providing for control of a elevator installation with multiple cars in which the allocation of the car decks improves the performance of the elevator installation.

The destination call control offers, with the call input at the floor and with the knowledge of the destination floor for each passenger, very important information which is of primary significance for the selection of the optimum elevator. Experiences with elevator installations with multiple cars and simulations show that it is very important in the case of elevator installations with multiple cars to minimize the number of stops of the multiple cars. This can only be achieved if the allocation of the car decks can be changed up to the last possible moment. It is of no significance to the user which deck brings him to the destination. The method according to the present invention has the purpose of a dynamic deck allocation to the individual destination calls. With the method, the allocation of each car deck is optimized on the basis of analysis of the allocations of other calls not only at the starting-point floor and the environment thereof, but also at the destination floor and the environment thereof.

The advantages achieved by the method according to the invention are essentially to be seen in that the number of necessary stops of the elevator car is automatically minimized. Moreover, there is prevention of unnecessary overlapping stops. An overlapping stop arises in the case of an elevator car with, for example, two car decks when only three instead of four floors are served with two stops. The allocation of the floors to several elevators of an elevator group can be optimized. In the case of between-floor traffic each of the elevators can be used; a division in even-numbered/uneven-numbered groups or uneven-numbered/even-numbered groups is not necessary. The users can be served in an optimum manner by matching the loading of the car decks or with full load of one car deck. The elevators can also be better utilized for special journeys, for example VIP operation.

An elevator group consists of, for example, a group of six elevators A, B, C, D, E, F each with a respective multiple car. It will be assumed that for a new destination call from the starting point floor S to the destination floor Z the allocation algorithm determines, in accordance with a known costs calculation principle for destination call controls, the elevator B as the most favorable elevator in terms of cost. Directly thereafter the car deck executing the travel request for the starting-point floor S to the destination floor Z is determined in accordance with the method according to the present invention. The method for dynamic allocation of the car decks is explained in more detail in the following description. The deck allocation is carried out internally of the control without communication to the user.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
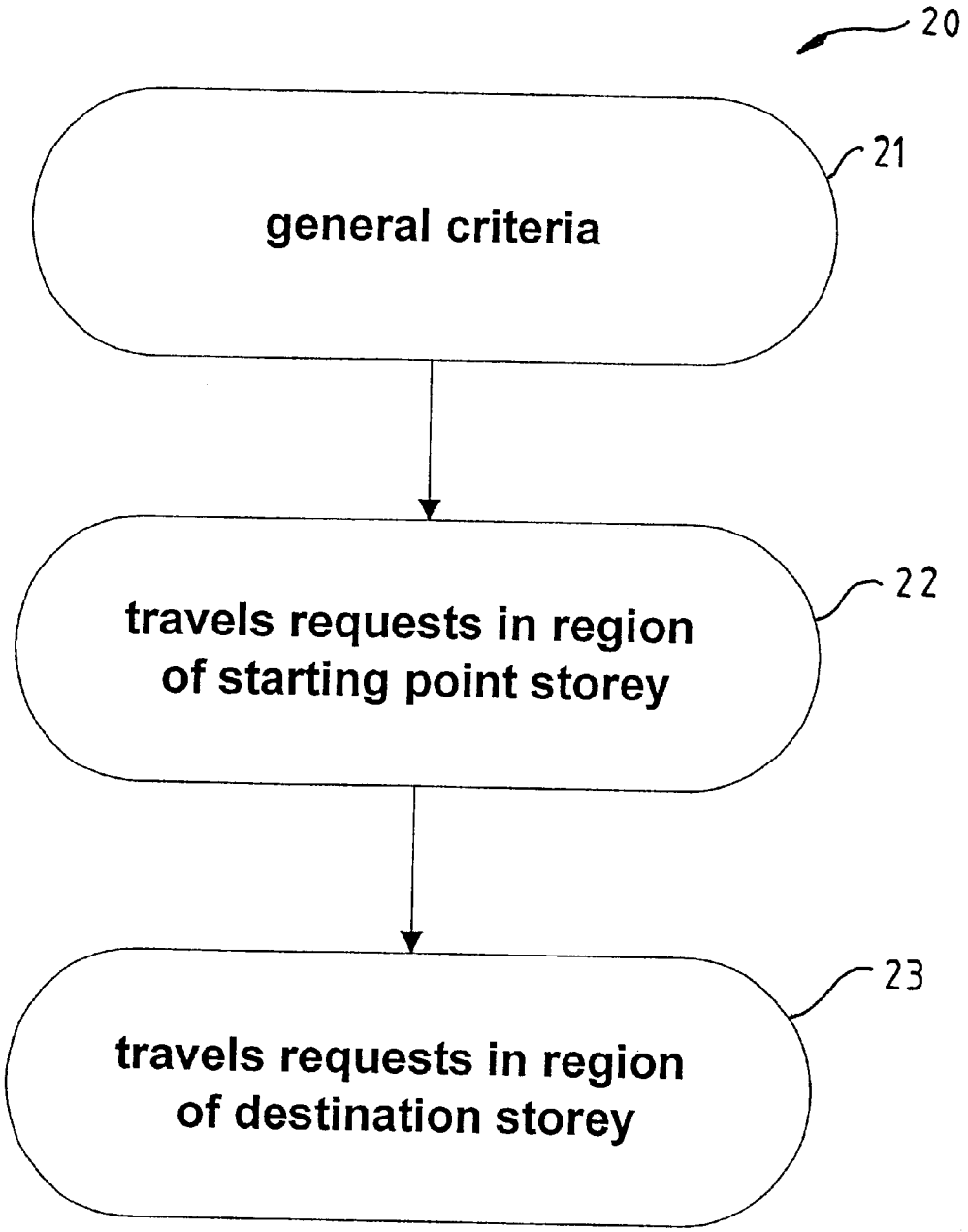
FIG. 1 is a flow diagram showing an overview of the deck allocation method according to the present invention.

The method of the present invention, which is shown in one embodiment illustrated in the drawings, for deck allocation relates to a elevator car with a lower and an upper deck (double-decker), wherein a load measuring device is provided for each deck. The method is also feasible for use on elevator cars with three or more decks. A typical double-decker car (also known as a double car elevator) with an associated group control is shown in the U.S. Pat. No. 5,086,883 which is incorporated herein by reference.

The abbreviations and references employed in the description of the method according to the present invention are defined as follows:

OD—Upper deck of the elevator car.

UD—Lower deck of the elevator car.

S—Starting-point floor (the travel request begins here with the input of the destination floor Z).

Region of the starting-point floor—Region comprising the adjacent floors S+1, S−1 or S+1, S+2, S−1, S−2 of the starting-point floor S.

Z—Destination floor (the travel request ends here).

Region of the destination floor—Region comprising the adjacent floors Z+1, Z−1 or Z+1, Z+2, Z−1, Z−2 of the destination floor Z.

LOD—Load of upper deck (load is measured each time before the start and stored).

LUD—Load of lower deck (load is measured each time before the start and stored).

OGLOD—Upper load limit of upper deck (selectable as a parameter).

OGLUD—Upper load limit of lower deck (selectable as a parameter).

UGLOD—Lower load limit of upper deck (selectable as a parameter).

UGLUD—Lower load limit of lower deck (selectable as a parameter).

PHBR—Braking phase of the elevator car (travel of the elevator car in coming to a stop before a floor stop).

PHH—Stop of the elevator car at a floor.

SP—Selector position (the selector leads during travel of the elevator car and scans the approaching floor).

SPOD—Selector position of upper deck.

SPUD—Selector position of lower deck.

Service OD—Use of the elevator car as a single-deck car (only the upper car deck serves as a transport deck).

Service UD—Use of the elevator car as a single-deck car (only the lower car deck serves as a transport deck).

Load balancing—Attempt towards loads of equal size in the two decks. The load balancing is selectable by means of parameters.

Predetermined stop VH—Required stop determined by boarding passengers or passengers located in the car (boarding stop or alighting stop). The elevator car must stop at this floor by the determined deck, because by virtue of the call allocation and deck allocation at least one passenger boards or alights.

Possible stop MH—A stop, which is planned by already booked passengers, with a planned deck at a floor. At least one boarding passenger or alighting passenger can still be served by one of the two car decks at this floor.

Reversal point—The lowest floor which the elevator reaches by the lower deck during a downward travel before the elevator changes the travel direction or the highest floor which the elevator reaches by the upper deck during an upward travel before the elevator changes the travel direction.

Position overlap—A position overlap arises with an elevator car with, for example, two car decks when only three, instead of four, floors are served by two stops.

Predetermined position overlap—Three adjacent floors are served by two stops, due to a Predetermined stop. Additional position overlaps are avoided by the method according to the invention.

Possible position overlap—Three adjacent floors are served by two stops, due to a Possible stop. Additional position overlaps are avoided by the method according to the invention.

Possible alighting passenger—It is provided for a specific floor that at least one already booked passenger, who has not yet boarded one of the decks, will alight. The previous deck allocation for this passenger could accordingly still be changed. Such a deck allocation change would, however, have a consequence of retrogressive action in the direction of the travel planning. Also, the previously applicable deck allocation would have to be changed for the boarding floor of this passenger, wherein this could cause further retrospective changes on other allocations. Accordingly, in this case a deck allocation change for the possible alighting passenger is renounced and, instead, a position overlap is accepted.

Possible boarding passenger—It is provided for a specific floor that at least one already booked passenger will board. The previous deck allocation for this passenger could accordingly still be changed. Such a deck allocation change would have an effect on the destination floor of this passenger. Such a deck allocation change for the a destination floor could have the consequence of further changes in the deck allocations for other passengers in the region of this destination floor. These possible deck allocation changes lie in the direction of the travel planning after the floor in question. Thus, the probability is higher (as with retrospective changes) that less deck allocation changes for other booked passengers are meant. Accordingly, a rebooking of the deck allocation for the possible boarding passenger is accepted if a position overlap is thereby prevented.

In the flow charts of the drawings, usual symbols are used, which together with the above legends are self-explanatory.

FIG. 1 is a flow chart of a deck allocation method 20 according to the present invention that begins allocation on the basis of general criteria in a step 21. The method 20 continues allocation based upon travel requests in the region of the starting-point floor in a step 22 and completes allocation based upon travel requests in the region of the destination floor in a step 23.

Figure 2:
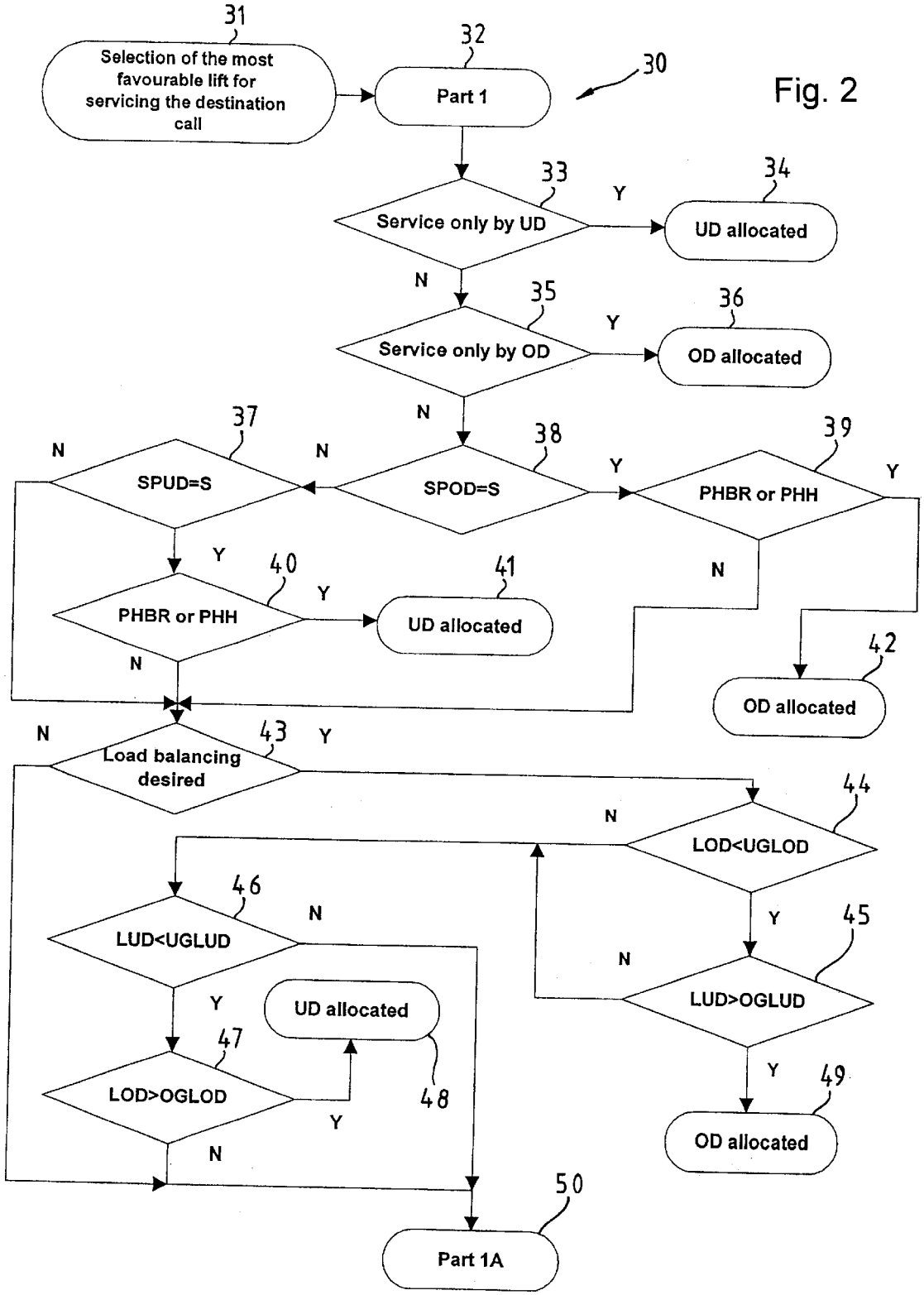
FIG. 2 is a flow diagram showing Part 1 of the method of FIG. 1 in more detail in which the deck allocation is performed on the basis of general criteria.

FIG. 2 shows a group of steps 30 undertaken at the start of the method according to the present invention, according to which the servicing of the destination call has been allocated to the most favorable elevator with a multiple car. The selection begins at a step 31 and further steps lead to a deck allocation on the basis of general criteria (Part 1 step 32).

In case only one of the two car decks UD, OD is to execute travel requests (steps 33 and 35), the destination call or the travel request is immediately allocated to one of the two car decks UD, OD (steps 34 and 36). It is thereafter checked whether the selector position SPUD (step 37) or SPOD (step 38) of the one or other car decks UD, OD is the same as the starting-point floor S and whether the elevator car is disposed in the braking phase PHBR or is engaged at a stop PHH at the floor (steps 39 and 40). If the elevator car is disposed in the braking phase PHBR or is engaged at a stop PHH at the floor, the travel request is allocated to one of the two car decks UD, OD (steps 41 and 42).

Parameter load balancing is detected (step 43) and if it is activated, it is checked whether the load LOD, LUD (steps 44 through 47) of the car decks OD, UD is greater or smaller than preselectable load limits OGLOD, OGLUD, UGLOD, UGLUD in order to allocate the passenger to the car deck UD, OD (steps 48 and 49) with less loading. The method then exits the group of steps 30 and proceeds to Part 1A (step 50).

Figure 3:
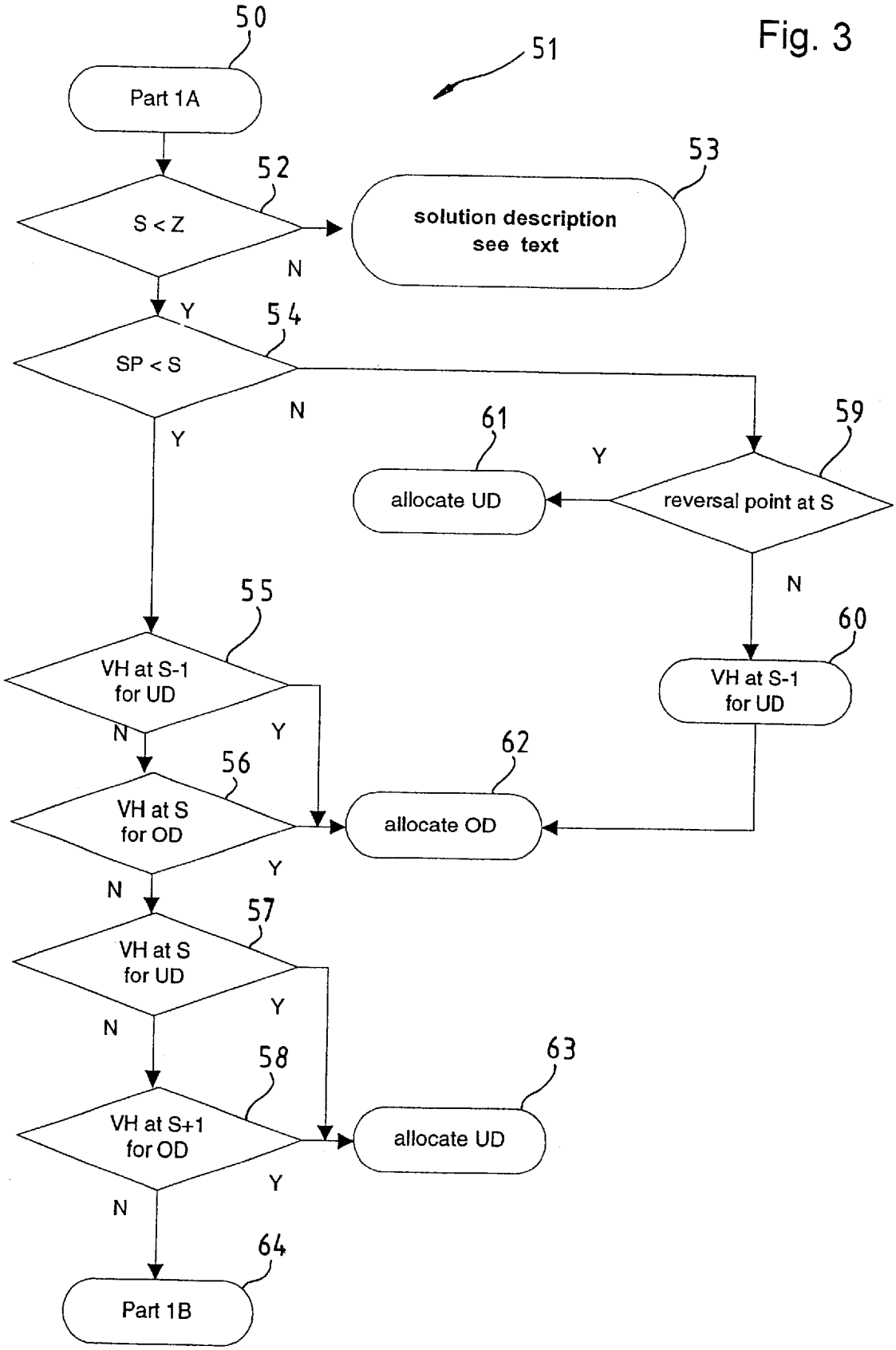
FIG. 3 is a flow diagram showing Part 1A of the method of FIG. 1 in more detail in which the deck allocation is performed on the basis of predetermined stops at the starting-point floor.

FIG. 3 shows the deck allocation on the basis of predetermined stops in a group of steps 51. The method enters the group 51 at the step 50 and initially it is checked whether the desired travel from the starting-point floor S to the destination floor Z is in upward direction (step 52 S<Z). If the check yields "N" (no, S>Z), the method is processed analogously to the solution illustrated in FIGS. 2 through 10 (step 53). In terms of content, the same interrogations are carried out, wherein the interrogations are adapted to the starting point floor or destination floor in accordance with the respective travel direction of the elevator.

The method of the following description applies to the case wherein travel from the starting-point floor S to the destination floor Z is in an upward direction and the elevator car travels to the starting-point floor S in an upward direction (step 54 SP<S) or in a downward direction (SP>S).

If the travel direction check (step 52 S<Z) yields "Y" (yes), it is checked on the basis of the selector position SP whether the elevator travels to the starting-point floor S in the upward direction (step 54 SP<S). If the step 54 check yields "Y", the further steps relate to predetermined stops which are caused by boarding passengers or passengers already located in the elevator car for the floor S−1 (step 55) or the starting-point floor S (step 56) on the one hand, or the starting-point floor S (step 57 or the floor S+1 (step 58) on the other hand. If the check step 54 (SP<S) yields "N" (starting-point floor S traveled to in the downward direction), the further steps relate to the checking of the reversal point (steps 59 and 60). According to the respective checking output in the individual checking steps, the desired travel is allocated to the upper car deck OD (step 62) or the lower car deck UD (steps 61 and 63). The method then exits the group of steps 51 and proceeds to Part 1B (step 64).

Figure 4:
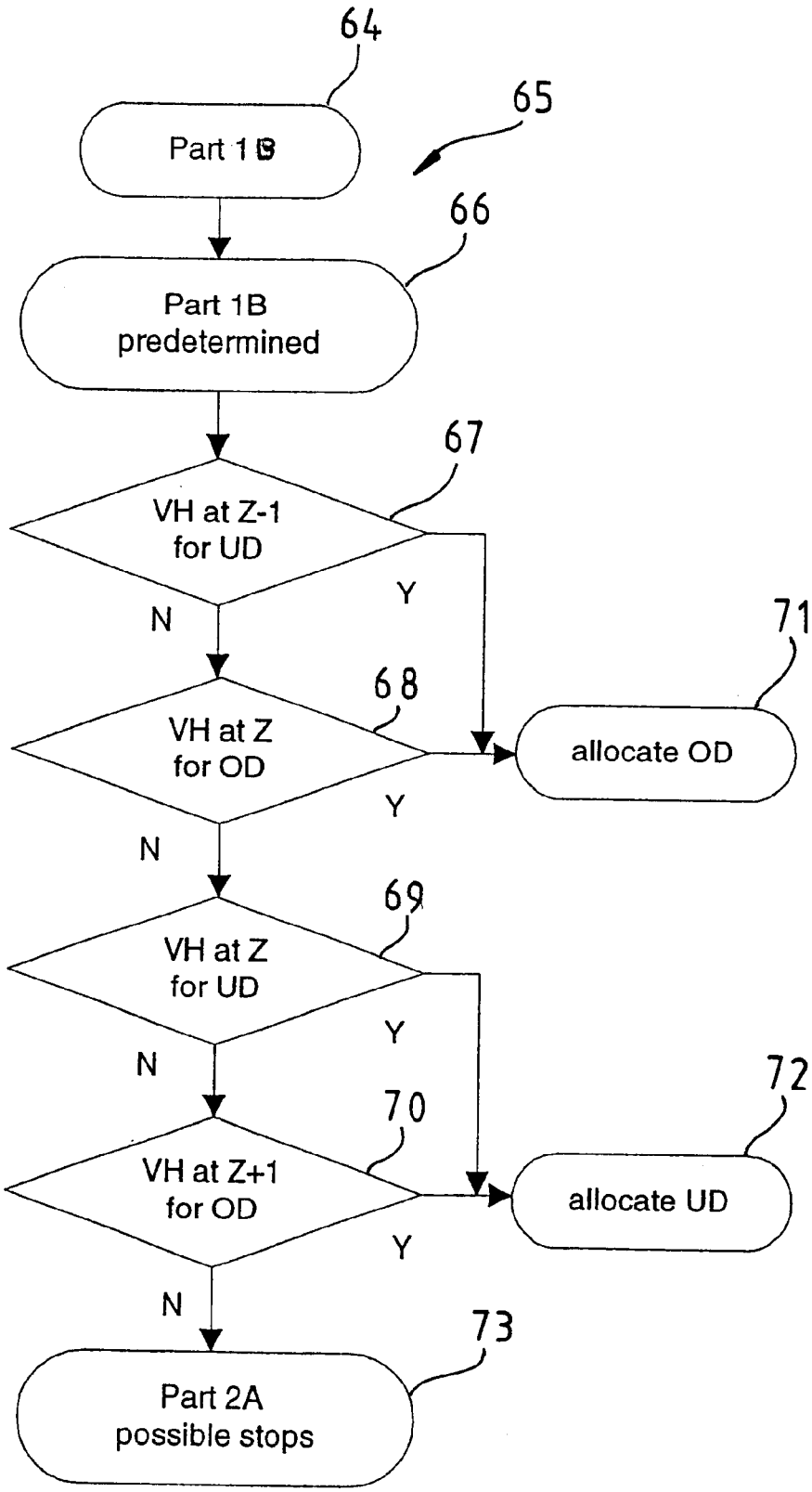
FIG. 4 is a flow diagram showing Part 1B of the method of FIG. 1 in more detail in which the deck allocation is performed on the basis of predetermined stops at the destination floor.

FIG. 4 shows the deck allocation on the basis of predetermined stops in a group of steps 65. The stops (step 66) are caused by boarding passengers or passengers already located in the elevator car for the floor Z−1 (step 67) or the destination floor Z (step 68) on the one hand, or the destination floor Z (step 69) or the floor Z+1 (step 70) on the other hand. According to the respective checking output in the individual checking steps the desired travel is allocated to the upper car deck OD (step 71) or the lower car deck UD (step 72). The method then exits the group of steps 65 and proceeds to Part 2A (step 73).

Figure 5:
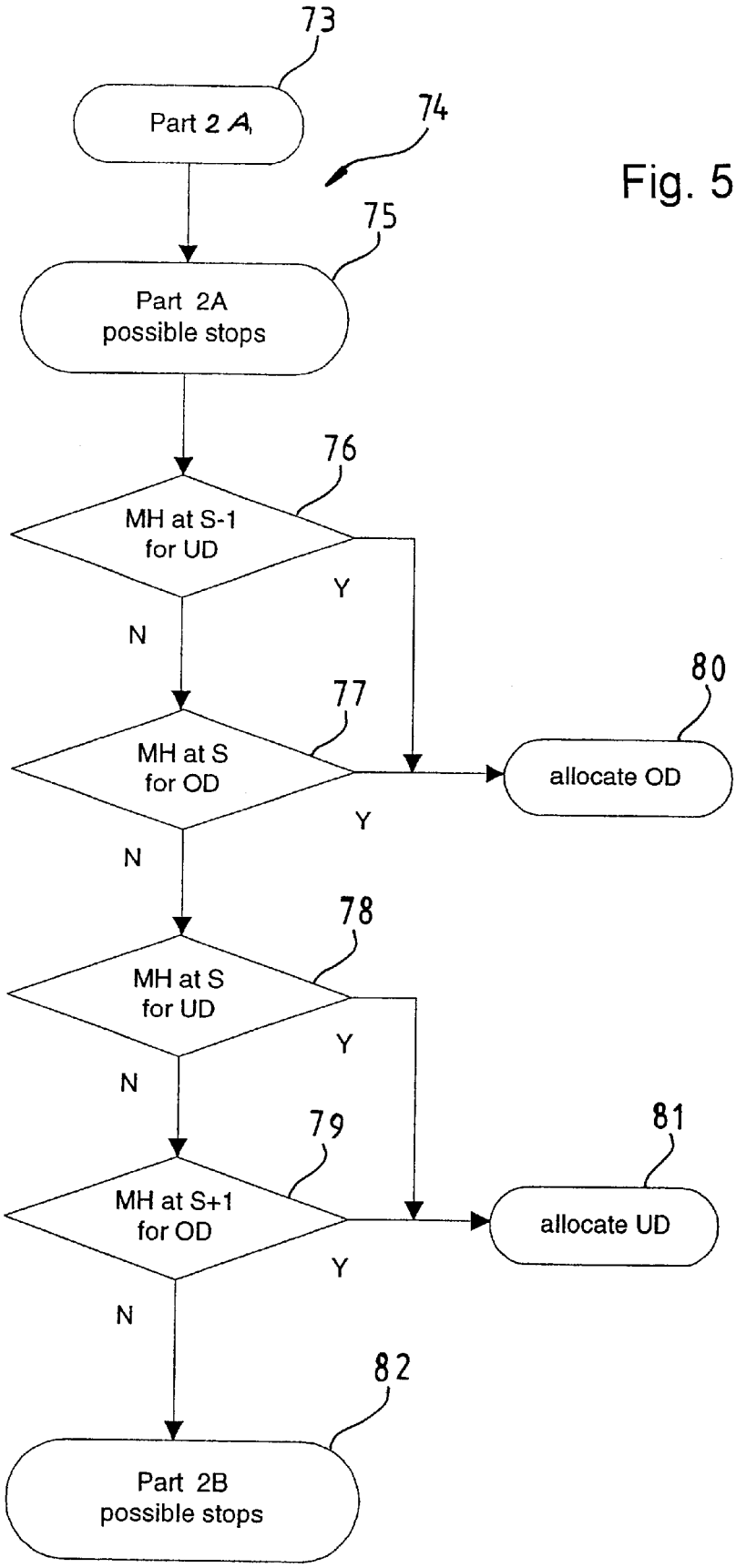
FIG. 5 is a flow diagram showing Part 2A of the method of FIG. 1 in more detail in which the deck allocation is performed on the basis of possible stops at the starting-point floor.

FIG. 5 shows the deck allocation on the basis of possible stops in a group of steps 74. The stops (step 75) are caused by booked, but not yet boarded, passengers for the floor S−1 (step 76) or the starting-point floor S (step 77) on the one hand, or the starting-point floor S (78) or the floor S+1 (79) on the other hand. These passengers can still be served by each car deck OD, UD. If the check (SP<S) yields "N" (starting-point floor S traveled to in downward direction), the further steps relate to checking of the reversal point. According to the respective checking output in the individual checking steps the desired travel is allocated to the upper car deck OD (step 80) or the lower car deck UD (step 81). The method then exits the group of steps 74 and proceeds to Part 2B (step 82).

Figure 6:
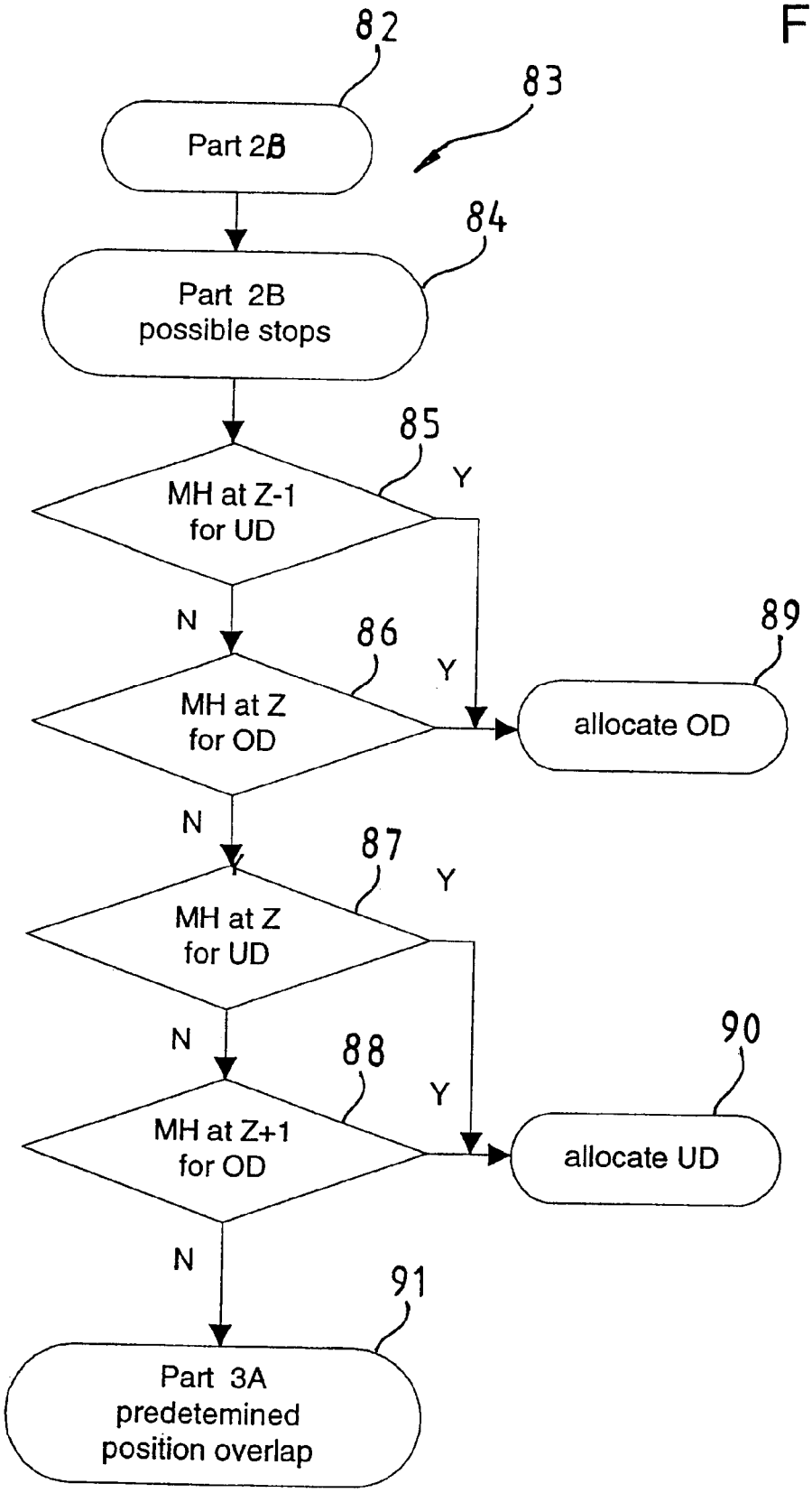
FIG. 6 is a flow diagram showing Part 2B of the method of FIG. 1 in more detail in which the deck allocation is performed on the basis of possible stops at the destination floor.

FIG. 6 shows the deck allocation on the basis of possible stops in a group of steps 83. The stops (step 84) are caused by booked, but not yet alighted, passengers for the floor Z−1 (step 85) or the destination floor Z (step 86) on the one hand, or the destination floor Z (87) or the floor Z+1 (88) on the other hand. These passengers can still be served by each car deck OD, UD. According to the respective checking output in the individual steps the desired travel is allocated to the upper car deck OD (step 89) or the lower car deck UD (step 90). The method then exits the group of steps 83 and proceeds to Part 3A (step 91).

If in the preceding Parts 1A, 1B, 2A and 2B no predetermined stops and no possible stops could be found, the attempt is continued by seeking position overlaps.

Figure 7:
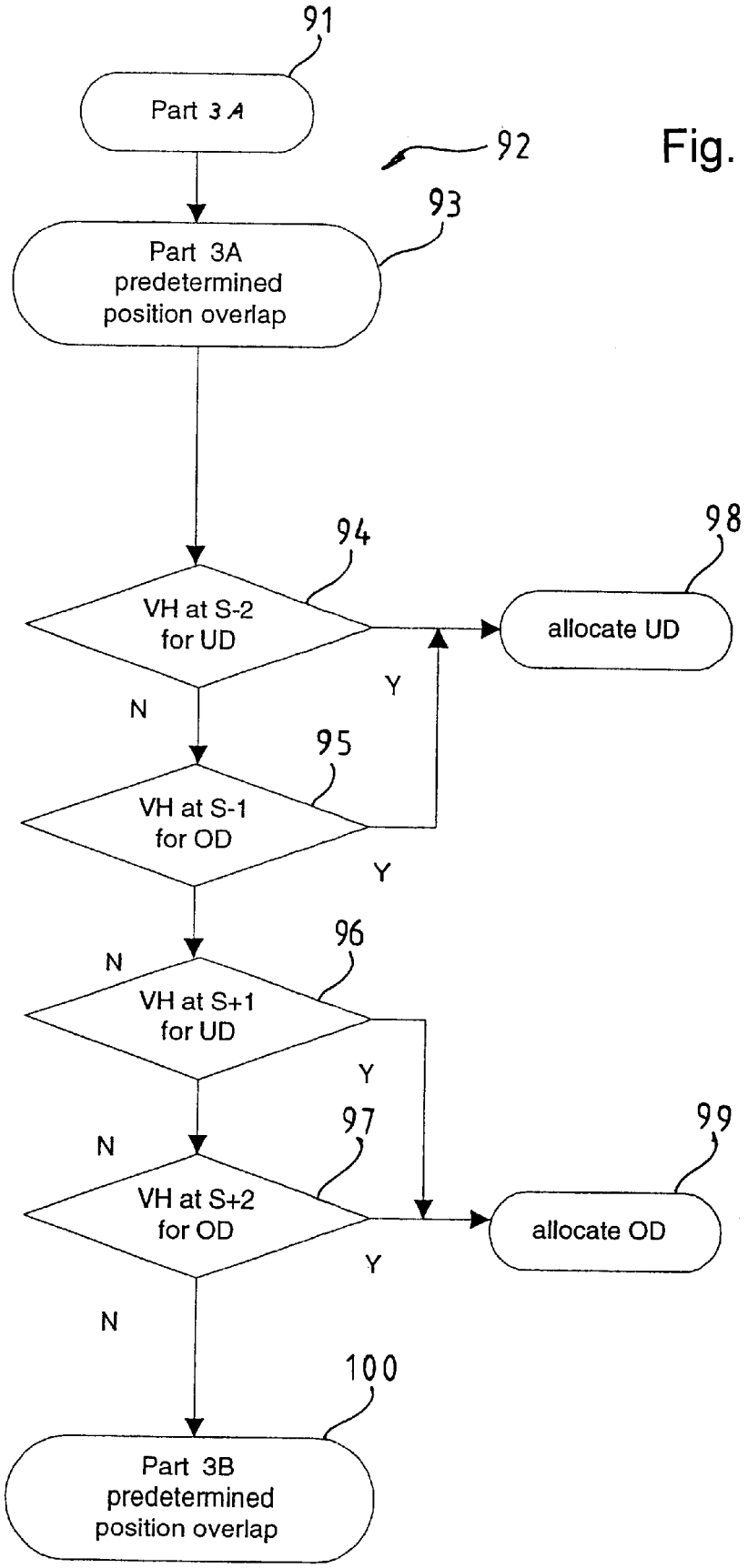
FIG. 7 is a flow diagram showing Part 3A of the method of FIG. 1 in more detail in which the deck allocation is performed on the basis of predetermined position overlaps, caused by booked alighting passengers, in the region of the starting-point floor.

FIG. 7 shows the deck allocation on the basis of predetermined position overlaps in a group of steps 92. The overlaps (step 93) are caused by predetermined stops for the floor S−2 (step 94), the floor S−1 (step 95), the floor S+1 (step 96) or the floor S+2 (step 97). In accordance with the respective checking output in the individual checking steps the desired travel is allocated to the upper car deck OD (step 99) or the lower car deck UD (step 98). The method then exits the group of steps 92 and proceeds to Part 3B (step 100).

Figure 8:
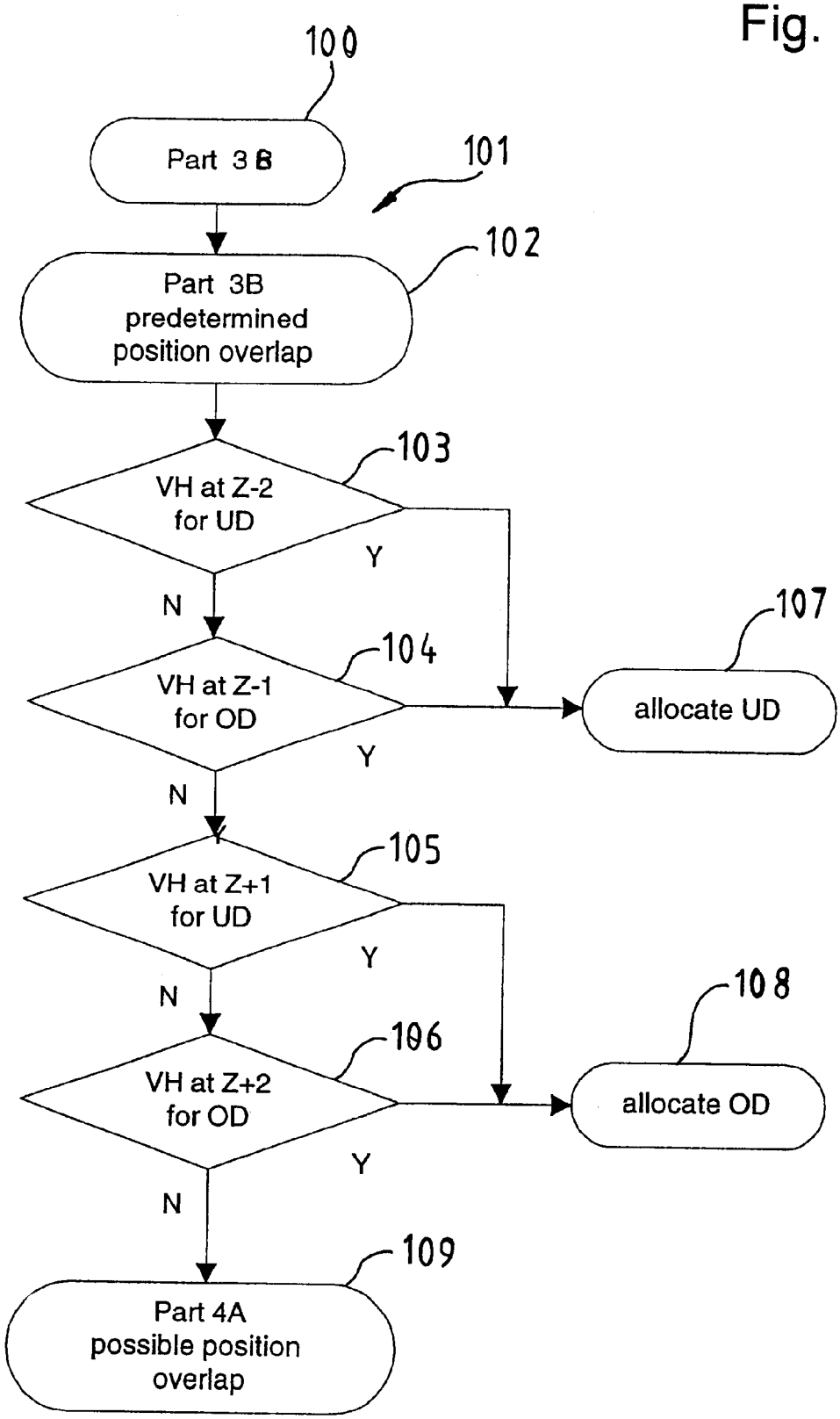
FIG. 8 is a flow diagram showing Part 3B of the method of FIG. 1 in more detail in which the deck allocation is performed on the basis of predetermined position overlaps, caused by booked alighting passengers, in the region of the destination floor.

FIG. 8 shows the deck allocation on the basis of predetermined position overlaps in a group of steps 101. The overlaps (step 102) are caused by predetermined stops for the floor Z−2 (step 103), the floor Z−1 (step 104), the floor Z+1 (step 105) or the floor Z+2 (step 106). In accordance with the respective checking output in the individual checking steps the desired travel is allocated to the upper car deck OD (step 108) or the lower car deck UD (step 107). The method then exits the group of steps 101 and proceeds to Part 4A (step 109).

Figure 9:
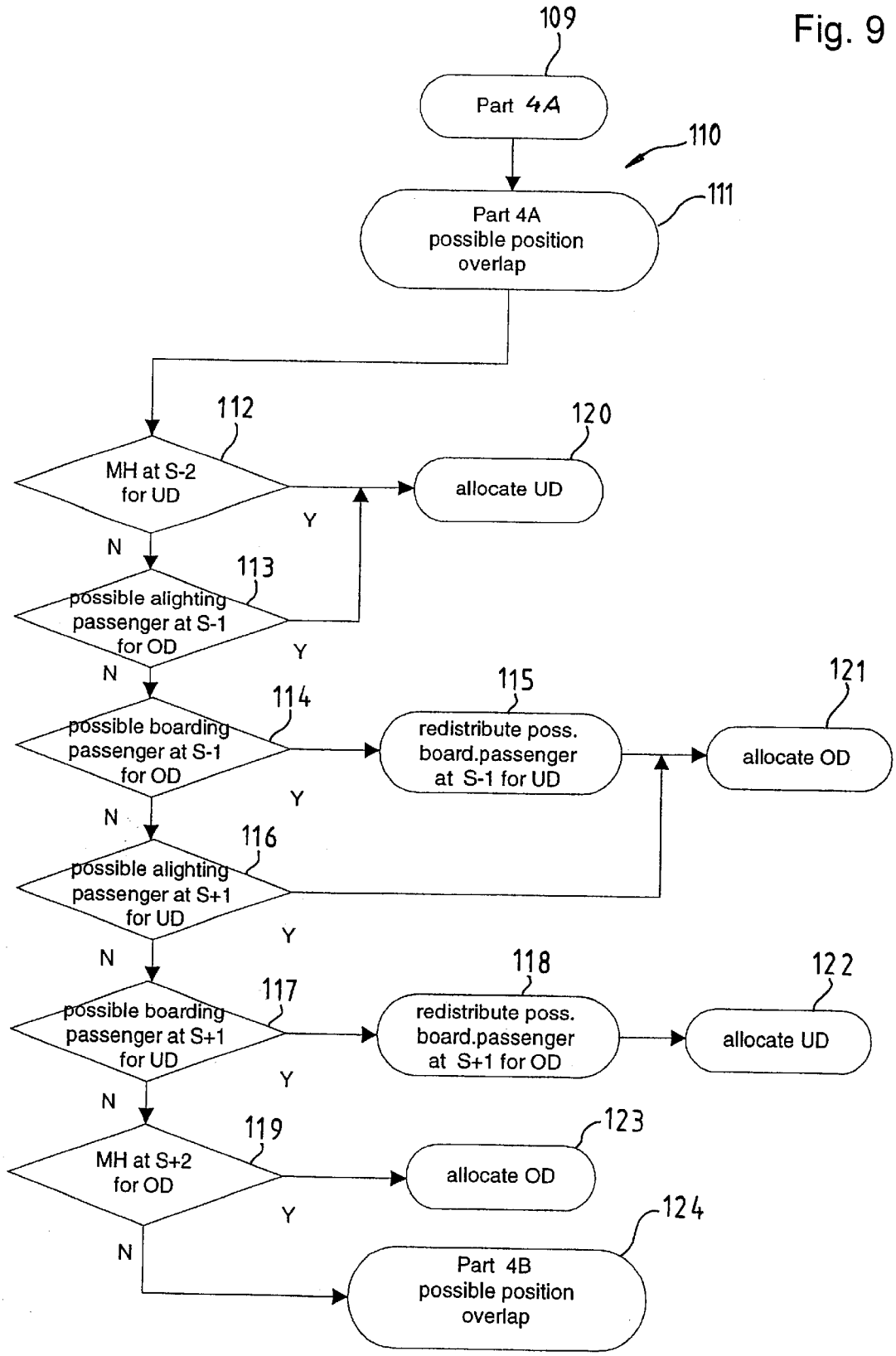
FIG. 9 is a flow diagram showing Part 4A of the method of FIG. 1 in more detail in which the deck allocation is performed on the basis of possible position overlaps, caused by booked boarding passengers, in the region of the starting-point floor.

FIG. 9 shows the deck allocation on the basis of possible position overlaps in a group of steps 110. The overlaps (step 111) are caused by possible stops for the floor S−2 (step 112) or the floor S+2 (step 119). For the floors S−1 and S+1 distinction is still made between "possible alighting passengers" (steps 113 and 116) and "possible boarding passengers" (steps 114 and 117) in order to decide about a possible deck allocation change (steps 115 and 118). According to the respective checking output in the individual checking steps the desired travel is allocated to the upper car deck OD (steps 121 and 123) or the lower car deck UD (steps 120 and 122). The method then exits the group of steps 110 and proceeds to Part 4B (step 124).

Figure 10:
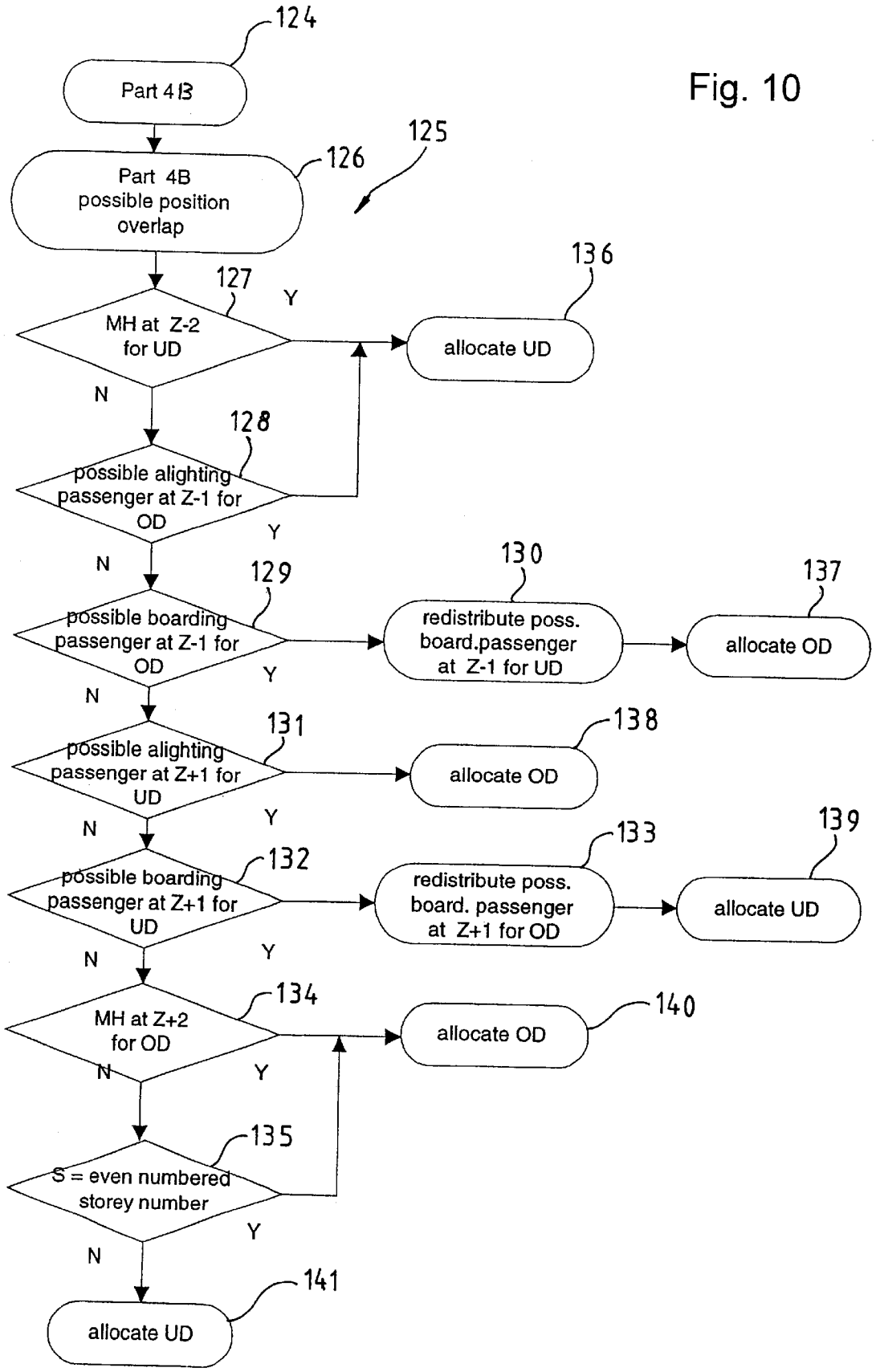
FIG. 10 is a flow diagram showing Part 4B of the method of FIG. 1 in more detail in which the deck allocation is performed on the basis of possible position overlaps, caused by booked boarding passengers, in the region of the destination floor.

FIG. 10 shows the deck allocation on the basis of possible position overlaps in a group 125. The overlaps (step 126) are caused by possible stops for the floor Z−2 (step 127) or the floor Z+2 (step 134). For the floors Z−1 and Z+1 distinction is still made between "possible alighting passengers" (steps 128 and 131) and "possible boarding passengers" (steps 129 and 132) in order to decide about a possible deck allocation change (steps 130 and 133). According to the respective checking output in the individual checking steps the desired travel is allocated to the upper car deck OD (steps 137, 138 and 140) or the lower car deck UD (steps 136 and 139).

If in the preceding parts 1A, 1B, 2A, 2B, 3A, 3B, 4A and 4B no predetermined stops, no possible stops, no predetermined position overlaps or no possible position overlaps could be found (step 135), the boarding passenger at the even-numbered starting-point floor is allocated to the upper car deck OD (step 140) and the boarding passenger at the uneven-numbered starting-point floor is allocated to the lower car deck UD (step 141).

The selection of the suitable car deck and thus the allocation of the travel request from the starting-point floor S to the destination floor Z takes place dynamically. The above-mentioned steps are performed continuously and the selection of the appropriate car decks optimized. The allocation takes place definitively, for example, only in the case of onset of braking for reaching the starting-point floor S.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A method of controlling an elevator installation with multiple multi-deck cars each having at least two decks for serving several floors simultaneously at one stop, wherein travel requests are allocated to the decks comprising the steps of:

a. initially allocating a travel request from a starting-point floor to a destination floor to a selected multi-deck elevator car;

b. allocating the travel request to one of the decks of the selected car based upon general criteria, allocated travel requests for a region of the starting-point floor, and allocated travel requests for a region of the destination floor; and c. finally allocating the travel request to a selected one of the decks of the selected car shortly before the selected one of the decks reaches the starting-point floor.

2. The method according to claim 1 wherein the step b. is repeated until a predetermined time before the selected one of the decks reaches the starting-point floor.

3. The method according to claim 1 wherein said general criteria of the step b. includes load states and selectable load limits of the decks.

4. The method according to claim 1 wherein the step b. is performed in dependence on predetermined stops in the region of the starting-point floor.

5. The method according to claim 1 wherein the step b. is performed in dependence on predetermined stops in the region of the destination floor.

6. The method according to claim 1 wherein the step b. is performed in dependence on possible stops in the region of the starting-point floor.

7. The method according to claim 1 wherein the step b. is performed in dependence on possible stops in the region of the destination floor.

8. The method according to claim 1 wherein the step b. is performed in dependence on predetermined position overlaps in the region of the starting-point floor.

9. The method according to claim 1 wherein the step b. is performed in dependence on predetermined position overlaps in the region of the destination floor.

10. The method according to claim 1 wherein the step b. is performed in dependence on possible position overlaps in the region of the starting-point floor.

11. The method according to claim 1 wherein the step b. is performed in dependence on possible position overlaps in the region of the destination floor.

12. The method according to claim 1 wherein the step b. is performed in dependence on at least one of predetermined stops in the region of the staring-point floor, predetermined stops in the region of the destination floor, possible stops in the region of the starting-point floor, possible stops in the region of the destination floor, predetermined position overlaps in the region of the starting-point floor, predetermined position overlaps in the region of the destination floor, possible position overlaps in the region of the staring-point floor, and possible position overlaps in the region of the destination floor.

13. The method according to claim 1 wherein in performing the step b. no predetermined stops, no possible stops, no predetermined position overlaps and no possible position overlaps are found; a boarding passenger at an even-numbered starting-point floor is allocated to an upper one of the decks and a boarding passenger at an uneven-numbered starting-point floor is allocated to a lower one of the decks.

14. A method of controlling an elevator installation with multiple multi-deck cars each having at least two decks for serving several floors simultaneously at one stop, wherein travel requests are allocated to the decks; comprising the steps of:

a. initially allocating a travel request from a starting-point floor to a destination floor to a selected multi-deck elevator car;

b. evaluating the travel request for allocation to one of the decks of the selected car based upon general criteria;

c. evaluating the travel request for allocation to one of the decks of the selected car based upon allocated travel requests for a region of the starting-point floor;

d. evaluating the travel request for allocation to one of the decks of the selected car based upon allocated travel requests for a region of the destination floor;

e. selecting one of the decks of the selected car based upon one of the steps b. through d. and allocating the travel request to the selected deck of the selected car; and f. finally allocating the travel request to the selected deck of the selected car shortly before the selected one of the decks reaches the starting-point floor.

* * * * *